United States Patent [19]

Iwata et al.

[11] 4,287,293

[45] Sep. 1, 1981

[54] PHOTOGRAPHIC ELEMENT

[75] Inventors: Tamotsu Iwata; Shigeru Iguchi, both of Nagaokakyo, Japan

[73] Assignee: Mitsubishi Paper Mills, Ltd., Tokyo, Japan

[21] Appl. No.: 110,751

[22] Filed: Jan. 8, 1980

[30] Foreign Application Priority Data

Jan. 18, 1979 [JP] Japan ..... 54-4250

[51] Int. Cl.[3] ..... G03C 5/54; G03C 1/72

[52] U.S. Cl. ..... 430/232; 430/510; 430/523; 430/536; 430/537; 430/627; 430/630; 430/961; 428/500

[58] Field of Search ..... 430/627, 630, 631, 213, 430/232, 523, 536, 961; 428/500

[56] References Cited

U.S. PATENT DOCUMENTS

| | | | |
|---|---|---|---|
| 2,957,767 | 10/1960 | Williams | 430/627 |
| 3,544,327 | 12/1970 | Abel et al. | 430/609 |
| 3,707,370 | 12/1972 | Rasmussen et al. | 430/627 |
| 3,723,127 | 3/1973 | Yano et al. | 430/505 |
| 3,730,726 | 5/1973 | Tsuji et al. | 430/381 |
| 4,119,463 | 10/1978 | Iguchi et al. | 430/630 |

*Primary Examiner*—J. Travis Brown

*Attorney, Agent, or Firm*—Cushman, Darby & Cushman

[57] ABSTRACT

A photographic element having a photographic layer such as silver halide emulsion layer, protective layer, intermediate layer, subcoat layer, diffusion transfer image-receiving layer, antihalation layer and backing layer, can be improved in the adhesion between the layer and support, little curling on drying, and flexibility of the layer, by incorporating into the photographic layer a conversion mixture of a polyvinyl alcohol having a saponification degree of 96% or more and an ethylene-maleic anhydride copolymer.

12 Claims, No Drawings

PHOTOGRAPHIC ELEMENT

This invention relates to a binder for forming a photographic layer of the photographic elements. The photographic layers, as herein referred to, include those which are not removed by the photographic processing, such as silver halide emulsion layer, protective layer, intermediate layer, subcoat layer, diffusion transfer image-receiving layer, antihalation layer, backing layer, etc.

In manufacturing photographic elements, generally a coating composition for forming a photographic layer such as silver halide emulsion layer is coated on a support material, and then the wet coating layer is allowed to congeal in a short period of time under a current of cool air. In almost all cases, the binder used in such a photographic layer of the photographic elements is gelatin because of its excellent gelation ability and other physical and photographic properties. Gelatin, however, has its advantages. Since it is a natural product, it is difficult to obtain in a constant quality, the properties being variable in a broad range depending upon the raw material and the manufacturing conditions. When gelatin is coated on a support material such as paper or film to form a photographic layer, it gives upon drying a hard and brittle layer and the coated support tends to curl due to contraction of the coating layer on drying.

Since, as described previously, in manufacturing a photographic element a coating composition is applied over a supporting material and allowed to congeal under a current of cool air, the gelation temperature of the coating composition (hereinafter this temperature is referred to as the setting temperature) affects in various respects the manufacturing process of a photographic element. When the setting temperature is low, there is required a refrigerating machine of high output, that is, a cool-air generating apparatus of a large capacity and a long-path chill zone; further, if the coating speed is increased, the applied coating tends to shift the position on the support due to insufficient setting, resulting in a non-uniform layer unsuitable for the practical use. To the contrary, a higher setting temperature provides the practical advantages of a shorter setting time and an efficient and effective high-speed coating which results in simplification of the cooling system including the chill zone and the cool-air generating apparatus, particularly a reduction in the required horsepower of the refrigerating machine.

The setting temperature of a coating composition depends primarily upon the gelation power of a water-soluble high molecular compound used as the binder. Although attempts have been made in the photographic industry to utilize various water-soluble high molecular compounds for the purpose of improving the defective properties of gelatin or even replacing gelatin as the binder, there has been developed none of the substances having sufficient photographic and physical properties to replace gelatin completely.

For instance, Japanese Patent Publication No. 22,504/1971 disclosed a method for preparing photographic elements, in which method an alkali metal nitrate and a product obtained by heating a styrene-maleic anhydride copolymer together with polyvinyl alcohol are added to a silver halide photographic emulsion having no gelation power necessary for uniform coating or having only an insufficient gelation power. However, as in the case of a photographic element prepared by using gelatin as binder, the photographic layer of the element obtained by the above method is hard and brittle, tending to craze in the surface or to break by overdrying and the element tends to curl due to the contraction of the emulsion layer on drying.

In the above method, if the coating composition contains gelatin, flocculation of the binder will take place under certain conditions (for example, at a low pH value, particularly below 4.0), thus spoiling completely the coating composition in actual case. According to the experimental results obtained by the present inventors, if a photographic element is prepared by the above method by using as supporting material in place of baryta paper a so-called RC paper sheet, now prevailing in the photographic industry, which is made by coating a paper sheet with a polymer of $\alpha$-defins having 2 to 10 carbon atoms such as polyethylene, polypropylene, and ethylene-butene copolymer, the resulting photographic element shows spontaneous separation of the photographic layer from the RC paper support during the preparation (after coating and drying) or development of the element or after treatment with processing solutions, indicating unsatisfactory adhesion between the RC paper and the photographic layer.

Japanese Patent Application Laid-open No. 124,920/1976 has disclosed a method which utilizes a binder comprising a conversion product prepared from polyvinyl alcohol and a styrene-maleic anhydride copolymer, which are the two components described in the aforesaid Japanese Patent Publication No. 22,504/1971, and an isobutylene-maleic anhydride copolymer as the third component to improve the photographic element disclosed in said Japanese Patent Publication, the photographic layer of which is hard and brittle and causes curling of the element by the contraction of photographic emulsion layer on drying. However, the improvement is still unsatisfactory in the flexibility of photographic layer, curling tendency of the element, and adhesion of the photographic layer to the RC paper sheet.

On being stored for a long period of time after their preparation, the conversion mixture described in the aforementioned Japanese Patent Publication No. 22,504/1971 and Japanese Patent Application Laid-open No. 124,920/1976 and subject to a change with time in physical properties, particularly in viscosity, giving rise to various troubles in preparing a coating composition or sometimes resulting in a product unsuitable for use as a binder.

A method was described in Japanese Patent Publication No. 4,272/1964 for minimizing the curling due to the contraction on drying of a gelatin-containing photographic layer by incorporating a methyl vinyl ether-maleic anhydride copolymer, an amide thereof, or an ester thereof into a binder comprising polyvinyl alcohol and gelatin to improve their compatibility. However, it is impossible to expect satisfactory elimination of the curling tendency by this method, because the photographic layer formed by this method contains gelatin in a specified amount in order not to deteriorate the water resistance and absorptive capacity for the developing solution.

An object of this invention is to provide an excellent photographic element which has been improved in the aforementioned defective properties of an element comprising a photographic layer formed by use of a water-soluble high molecular binder.

The above object of this invention can be achieved by incorporating into the photographic layer a conversion mixture of a polyvinyl alcohol having a saponification degree of 96% or more and an ethylene-maleic anhydride copolymer.

The advantageous features of the photographic element of this invention are such that the photographic layer formed by coating on a support is flexible and withstands the contraction on drying with little curling and, in addition, the adhesion between the photographic layer and the RC (Resin Coated) paper sheet used as support is sufficiently strong for obviating the troubles arising from peeling of the photographic layer of the support.

Further, the binder of this invention exhibits a desirable feature of elevating the setting temperature of a coating composition when used in combination with a water-soluble high molecular compound having a gelation property, such as gelatin, in preparing a photographic element.

Other characteristic properties and advantages of the photographic element of this invention and the binder used therein will become apparent from the following description.

The conversion mixture of PVA and ethylene-maleic anhydride copolymer can be formed either by allowing polyvinyl alcohol and ethylene-maleic anhydride to react in an aqueous solution or by coating both components on a support and allowing to react by standing or heating; in the latter case, the conversion mixture is formed in situ within the photographic layer. However, in view of the convenience for the preparation of a photographic element, it is preferable to carry out the reaction in an aqueous solution until the viscosity of the solution exceeds a value about 1.5 times the initial value of the mixture of aqueous solutions of polyvinyl alcohol and ethylene-maleic anhydride copolymer. This reaction proceeds at room temperature, but the reaction time is too long to be practical. Therefore, it is preferable to accelerate the reaction by heating or other means. Suitable polyvinyl alcohol, ethylene-maleic anhydride copolymer and reaction conditions (temperature, pH, etc.) are described below in detail.

Polyvinyl alcohol, one of the components of the binder according to this invention, is available in various types with different saponification degrees and polymerization degrees. Particularly the saponification degree is a very important factor. A commercial grade, commonly known as partially saponified polyvinyl alcohol, having a saponification degree of as low as about 88% is easily soluble in water. A photographic layer containing a conversion mixture prepared from such a grade is inferior in water resistance and easily loses the binder on washing with water. It is indeed possible to impart water resistance to such a photographic layer by the incorporation of a substance (a hardener) which hardens the layer. For this purpose, however, a large amount of a hardener must be incorporated. In view of the effects on physical and photographic characteristics of the photographic layer and on the manufacturing process, such a binder is unsuitable for use in photographic layers. Physical properties of polyvinyl alcohol vary with the saponification degree and the change becomes more significant when the saponification degree exceeds 90%. Particularly, a slight change in the saponification degree in the range of 95 to 100% affects markedly the physical properties of polyvinyl alcohol. The conversion mixture prepapred from an ethylene-maleic anhydride copolymer and a polyvinyl alcohol having a saponification degree of about 95% acquires a certain degree of water resistance, through insufficient. A satisfactory binder is obtained only by using a polyvinyl alcohol having a saponification degree of 96% or higher. Especially, a polyvinyl alcohol having a saponification degree of 98% or higher gives a conversion mixture having characteristics satisfactory for the object of this invention, as described later.

The viscosity of the conversion mixture increases with the increase in polymerization degree of polyvinyl alcohol. Although the strength of a photographic layer becomes higher with the increase in the polymerization degree of polyvinyl alcohol used, a polyvinyl alcohol having too high a polymerization degree gives a coating composition of too high a viscosity for uniform coating. The polymerization degree of polyvinyl alcohol should be suitably selected by taking into account the consistency of the coating composition which varies according to the particular coating procedure and the object of the photographic layer. An intended result will be obtained in most cases by using commercial grades having average polymerization degrees in the range of 300 to 2,000, each alone or in mixtures.

As for the ethylene-maleic anhydride copolymers, those having a comparatively low polymerization degree are suitable, while those having a high polymerization degree are not easily soluble or form a conversion mixture having too high a viscosity for easy handling and smooth coating. An average molecular weight of 8,000 to 100,000 is suitable, though not limitative.

When a mixture of solutions containing polyvinyl alcohol and ethylene-maleic anhydride copolymer, respectively, is heated, the viscosity of the reactant mixture increases with the temperature and the heating time. The reaction conditions such as temperature and reaction time are suitably selected according to the molecular weights, mixing ratio, and concentrations of both component resins and the pH of the solution. The reaction does not proceed at a pH of 6 or higher and the rate of reaction increases with the decrease in pH. A desirable result is obtained generally at a pH in the range of 3 to 5, particularly at about ph 4. The viscosity of the reactant mixture increases more rapidly with the increase in molecular weights of the reactants. The rate of reaction is very small at temperatures below 60° C. and the reaction time becomes smaller with the increase in temperature. The reaction is generally carried out at 90° to 100° C. for several hours (about 3 to 4 hours). Desirable results are obtained when the mixing ratio of polyvinyl alcohol to ethylene-maleic anhydride copolymer is 1,000:100–500 by weight.

As aforementioned, a conversion mixture of polyvinyl alcohol and ethylene-maleic anhydride copolymer may have any viscosity by suitably selecting the polymerization degree or average molecular weight of each component, the reaction conditions such as temperature, time and pH, and the mixing ratio of the components. By use of a suitable conversion mixture, the coating composition can be adjusted to any viscosity suitable for particular coating procedure to be adopted. This is one of the advantageous features of this invention.

The conversion mixture of this invention can be stored at room temperature in the form of aqueous solution ready for use when required. Being excellent in shelf life, the aqueous solution undergoes neither significant change in viscosity and pH nor bacterial decomposition, as is the case with gelatin, during a long storage period.

In preparing the photographic element of this invention, the above-said conversion mixture can be used as a single binder or a mixed binder cojointly with other water-soluble high molecular compounds such as, for example, homopolymers or vinylpyrrolidone, acrylamide, and acrylic acid or copolymers thereof, acrylamide-vinylimidazole copolymers, acrylamide-diacetone-acrylamide-vinylimidazole terpolymers, and acrylamide-diacetone-acrylamide-vinylimidazole-acrylic acid quaterpolymers. The conversion mixture of this invention is highly compatible with those water-soluble polymers such as gelatin and vinylimidazole-containing polymers which contain basic groups such as amino group and imidazole group.

By using as binder the conversion mixture of this invention either alone or in a mixture with gelatin or other commonly used water-soluble polymers, there is obtained a photographic element comprising a photographic layer (or layers) which does not cause appreciable curling of the element due to the contraction on drying and which adheres firmly to a RC paper support if used. Further, when used cojointly with other binders, such as gelatin, having a gelation ability, the conversion mixture of this invention causes an increase in setting temperature, an effect valuable for the preparation of photographic elements. A high setting temperature permits not only employing coating and drying methods similar to those commonly used for the conventional coating composition containing only gelatin as binder, but also adopting the high-speed coating technique more efficiently and effectively with simplified cooling section of the coating unit. Although the conversion mixture of this invention and gelatin or other commonly used water-soluble polymers can be used cojointly in any ratio, it is preferable to incorporate about 5% (based on total weight of the mixed binder) or more of the conversion mixture.

Further, the conversion mixture of this invention possesses both the permeability to photographic processing solutions and the water resistance, which are two of the properties requisite for a binder forming a photographic layer. With the increase in heating time of the conversion mixture of this invention, the water resistance of a photographic layer containing the conversion mixture increases accompanying no decrease in permeability to processing solutions. Accordingly, as compared with a photographic element containing gelatin as the sole binder, the photographic element of this invention endures photographic processing at higher temperatures (e.g. 35° to 40° C.) or can be processed in a shorter period of time at ordinary temperature (about 20° C.)

The conversion mixture of this invention has a hardening action in addition to the aforementioned advantageous characteristics. Generally, hardeners are used in photographic elements containing gelatin as binder. There are many proposed hardeners, as described or cited as examples by Mees and James in "The Theory of the Photographic Process" (3rd. Ed., 1966, published from Macmillan Co., ), such as aldehydes, halocarboxylic acids, vinylsulfone compounds, aziridine compounds, epoxy compounds, active halogen compounds, and many other inorganic and organic compounds. In the case of the photographic element in which the conversion mixture of this invention was used together with gelatin as binder, although depending on the type and the intended use of the element, the photographic layer is hardened sufficiently for practical use by the hardening effect of the conversion mixture without the addition of a hardener and can withstands the treatment by processing solutions, e.g. developer solution, without being washed off nor becoming loose. The hardening effect of the conversion mixture is especially marked when it is prepared by use of a polyvinyl alcohol having a saponification degree of 98% or more. When the saponification degree of polyvinyl alcohol is below 98%, it is preferable to add a small amount of a hardener. If necessary, depending upon the type and use of the photographic element, it is not ojectionable to add a hardner known in the art.

A photographic element for the silver complex diffusion transfer process, which has preferable characteristics in addition to the aforesaid features and advantages, is obtained by using the conversion mixture of this invention jointly with gelatin or other water-soluble high molecular compounds as the binder for forming an image receiving layer. In general, a photographic element for the silver complex diffusion transfer is evaluated in terms of transfer image density, transfer speed, and silver image tone among others. A high transfer image density, expressed as either transmission density or reflection density, is particularly preferred when the photographic element is used as a block copy material in the photomechanical process. The photographic element for silver complex diffusion transfer process having an image receiving layer formed by using as the binder the conversion mixture of this invention either alone or together with gelatin or other water-soluble polymers is characterized by its high quality, particularly high transfer image density. When the conversion mixture of this invention is used jointly with gelatin which is particularly preferred to other water-soluble polymers, there is obtained an image receiving layer higher in transfer image density than a receiving layer formed by using gelatin alone as the binder. Accordingly, the use of the conversion mixture in an image receiving layer is one of the preferred embodiments of this invention and an excellent photographic element for the silver complex diffusion transfer process having a high transfer image density and aforementioned characteristics is obtained.

In general, the image receiving layer of a photographic element for silver complex diffusion transfer contains substances, known as physical development nuclei, such as sulfides, selenides, polysulfides and polyselenides of heavy metals such as silver, nickel, cobalt, copper, zinc, antimony, bismuth, cadmium, lead and palladium; mercaptans, stannous halides, metallic selenium compounds, fogged silver halides, and colloidal metals such as silver, gold, platinum, palladium and mercury. Further, the image receiving layer contains, if necessary, other additives such as, for example, toners, developing agents, surface active agents, etc. The presence of the conversion mixture in the image receiving layer does not restrain in any way the addition of any of the above-noted additives.

Two systems of photographic elements are now in use in the silver complex diffusion transfer process. In the one system, both the image receiving layer containing physical development nuclei and the silver halide emulsion layer are disposed on the same support and treated with a developing solution and other processing solutions to obtain an image. In the other system, the image receiving layer containing physical development nuclei and the silver halide emulsion layer disposed separately on different supports are treated with processing solutions and then brought into contact with each other to obtain an image. The present invention can be embodied in either system with the same desirable result of increased image density.

Non-limitative examples of photographic elements suitable for the embodiment of this invention include those for use in black-and-white photography, color photography, photomechanical process, X-ray photography, micro-film photography, reproduction photography, and diffusion transfer process.

In manufacturing the photographic elements of this invention, a photographic coating composition can be prepared by using the conversion mixture of this invention together with a protective colloid such as gelatin or other water-soluble polymers or by mixing the conversion mixture with a liquid composition such as an aqueous dispersion containing no binder component of such protective colloid.

The formation, dispersion, and physical ripening of silver halide used in practicing this invention can be carried out advantageously by various known techniques and under known conditions. Examples of the known techniques include normal single-jet method, reverse mixing method, double-jet method, conversion silver halide method as described in Japanese Patent Publication No. 7,772/71 and U.S. Pat. No. 2,592,250, ammonia method, acid or neutral method, alkaline method, ethylenediamine method described in U.S. Pat. No. 2,448,534, silver iodide nucleus method described in Japanese Patent Application Laid-open No. 65,925/73, and various combination methods. The silver halide composition (e.g. silver iodobromide, silver bromide, silver chlorobromide and silver chloroiodobromide), crystal form and habit of silver halide grains are free from any restriction.

The silver halide emulsion layer contains (generally admixed during physical ripening) various additives including metal ions such as, for example, cadmium ion, zinc ion, rhodium ion, iridium ion, lead ion, thallium ion, lithium ion, calcium ion, and combinations of two or more ions (e.g. a combination of rhodium ion and iridium ion described in, for example, Japanese Patent Publication No. 33,781/74), and various crystal habit controlling agents, as described in *The Journal of Photographic Science, Vol.* 13 (1965), such as alkyl pyridinium salts, thiourea, 3-mercapto-4-methyl-5-ethyl-1,2,4-triazole, 1-phenyl-5-mercaptotetrazole, and 2-mercaptobenzimidazole.

Further, the silver halide emulsion can be chemically sensitized with various sensitizers such as, for example, sulfur sensitizers (e.g. sodium thiosulfate, thiourea, gelatin containing labile sulfur, etc.), noble metal sensitizers (e.g. Auric chloride, ammonium chloroplatinate, silver nitrate, silver chloride, palladium salts, rhodium salts, iridium salts, and ruthenium salts), polyalkylenepolyamine compounds described in U.S. Pat. No. 2,518,698, iminoaminomethane-sulfinic acid, and reduction sensitizers (e.g. stannous chloride).

The structural components of the photographic elements of this invention may contain various additives such as the following:

Hardeners: Aldehyde compounds such as formaldehyde and glutaraldehyde; compounds having active halogen atoms described in U.S. Pat. Nos. 3,288,775 and 2,732,303, Brit. Pat. Nos. 974,723 and 1,167,207; ketone compounds such as diacetyl and cyclopentadiene; bis(2-chloroethylurea), 2-hydroxy-4,6-dichloro-1,3,5-triazine, divinylsulfone, 5-acetyl-1,3-diacryloyl, hexahydro-1,3,5-triazine; compounds having active olefin, N-hydroxyl-methylphthalimide, etc. described in U.S. Pat. Nos. 3,635,718 and 3,232,763, Brit. Pat. No. 994,809; N-methylol compounds described in U.S. Pat. Nos. 2,732,316 and 2,586,168; isocyanates described in U.S. Pat. No. 3,103,437; acid derivatives described in U.S. Pat. Nos. 2,725,294 and 2,725,295; compounds of the carbodiimide type described in U.S. Pat. No. 3,100,704; epoxy compounds described in U.S. Pat. No. 3,091,537; isooxazole compounds described in U.S. Pat. Nos. 3,321,313 and 3,543,292; halogenocarboxyaldehydes such as mucochloric acid; dioxane derivatives such as dihydroxydioxane and dichlorodioxane; and inorganic hardeners such as chrome alum, zirconium sulfate, and chromium trichloride.

Anti-fogging agents and stabilizers: compounds described or cited as examples in *Journal of the Society of Photographic Science and Technology of Japan,* 23, 34–40 (1960), 113–117 (1960); U.S. Pat. No. 2,716,062; *Photographic Science and Engineering,* 3, 268–271 (1959); U.S. Pat. Nos. 2,944,900, 2,131,038, 2,694,716, 2,886,437, 2,444,605, 3,287,135, 3,236,652, 2,403,927, 3,266,897, 3,397,987, 2,839,405, 3,220,839; Brit. Pat. No. 623,448; Japanese Patent Publication No. 5,647/76; Japanese Patent Application Laid-Open No. 107,129/76; and other known anti-fogging agents and stabilizers.

Surface active agents; saponins; anionic compounds such as sodium alkylbenzenesulfonates, sulfosuccinate ester salts; alkylarylsulfonates described in U.S. Pat. No. 2,600,831; and amphoteric compound in U.S. Pat. No. 3,133,816.

Fluorescent brightners such as those described in Japanese Patent Publication No. 7,127/59.

Wetting agents such as waxes, higher fatty acid glycerides and higher alcohol esters.

Mordants such as N-guanylhydrazone compounds, quaternary onium compounds and tertiary amine compounds.

Antistatics such as diacetylcellulose, styrene-perfluoroalkylene-sodium maleate copolymer, and sodium salt of reaction product of styrene-maleic anhydride copolymer and p-aminobenzenesulfonic acid.

Matting agents such as polymethacrylate esters, polystyrene, and colloidal silica; agents for improving physical properties of coating layer such as acrylate esters and various latices; plasticizers for gelatin such as glycerol and substances described in Japanese Patent Publication No. 4,939/68; antioxidants; pH regulating agents; developing agents such as, for example, hydroquinone and 1-phenyl-3-pyrazolidone; fixing agents such as sodium thiosulfate; and physical development nuclei such as, for example, heavy metals and sulfides thereof.

For the supports of photographic elements of this invention, use is made of various materials including paper sheets and films such as, for example, cellulose nitrate film, cellulose ester film, polyvinyl acetal film, polyethylene terephthalate film, and polystyrene film. The paper sheets can be partially acetylated or coated with baryta or polymers of olefines having 2 to 10 carbon atoms, such as polyethylene, polypropylene, and ethylene-butene copolymers. If necessary, the supports are applied with subcoatings. It is also possible to treat the support surface by exposing to corona discharge, glow discharge, other electron beam treatments, flame treatment, surface roughening treatment, and ultraviolet radiation.

The photographic elements of this invention can contain, if necessary, suitably selected additives other than those described above. The pH of the photographic layer is preferably in the range from 3.0 to 7.0, though not limitative.

The invention is illustrated below in detail with reference to Examples and Reference Examples, but the invention is not limited to those examples.

REFERENCE EXAMPLE 1

Following solutions were prepared.

Solution A

A mixture was prepared from 800 g of a 10% aqueous solution of a polyvinyl alcohol (average polymerization degree, 1,000; saponification degree, 98% or more) and 200 g of a 10% aqueous solution of an ethylene-maleic anhydride copolymer (EMA 31, trademark for Monsanto Co., U.S.; average molecular weight, 100,000). The resulting solution was adjusted to pH 4.0 with an aqueous sodium hydroxide solution.

A portion of solution A was put aside (solution A-0) and the remainder was divided into portions and heated for different intervals of time to obtain five conversion mixtures (A-1 to A-5) of varied heating time.

Solution B

A mixture was prepared from 750 g of a 10% aqueous solution of a polyvinyl alcohol (average polymerization degree, 1,700; saponification degree, 98% or more) and 250 g of a 10% aqueous solution of an ethylene-maleic anhydride copolymer (EMA 21, trademark for Monsanto Co., U.S.; average molecular weight, 25,000). A portion was put aside (solution B-0) and the remainder was treated similarly to Solution A to obtain four conversion mixtures (B-1 to B-4).

Solution viscosities at 80° C. of solutions A-0 and B-0 and conversion mixtures A-1 to A-5 and B-1 to B-4 were measured by means of a Brookfield-type viscosimeter (made by Tokyo KEIKI CO., LTD.). The results obtained were as shown in Table 1.

TABLE 1

| | | Heating time (minute) | Viscosity (cps) |
|---|---|---|---|
| Solution | A-0 | 0 | 188 |
| Conversion mixture | A-1 | 60 | 318 |
| Conversion mixture | A-2 | 90 | 398 |
| Conversion mixture | A-3 | 135 | 530 |
| Conversion mixture | A-4 | 195 | 740 |
| Conversion mixture | A-5 | 225 | 1350 |
| Solution | B-0 | 0 | 291 |
| Conversion mixture | B-1 | 60 | 461 |
| Conversion mixture | B-2 | 120 | 568 |
| Conversion mixture | B-3 | 180 | 840 |
| Conversion mixture | B-4 | 240 | 1338 |
| — | | — | — |

Each of the above solutions and conversion mixtures was mixed with gelatin and tested for the hardening effect of the conversion mixture used as binder.

Each of the solutions A-0, conversion mixtures A-1 to A-5, solution B-0, and conversion mixtures B-1 to B-4 was mixed with an aqueous solution of gelatin in a weight ratio of 1:1 in terms of solids. The resulting solution was coated on a polyethylene-coated paper, which had been exposed to corona discharge, so that the thickness of dried coating became 2μ and dried. Each test specimen thus prepared was kept at 50° C. for 4 days, then immersed in a processing solution, described below, at 20° C. for 90 seconds and immediately tested for the hardening degree. The test was performed by placing the test specimen on a horizontal plane, bringing a ball-pointed (0.5 mm in diameter) needle vertically into contact with the coating surface of the test specimen, and moving the latter horizontally at a constant speed (1 cm/sec.). The hardening degree was expressed in terms of the load applied to the needle which was required to scratch the coating surface. The results obtained were as shown in Table 2.

Processing solution

| | |
|---|---|
| Water | 700 ml |
| Sodium thiosulfate, Anhy. | 15 g |
| Sodium sulfite, Anhy. | 69 g |
| Potassium bromide | 1 g |
| Hydroquinone | 13 g |
| Phenidone | 1 g |
| Sodium hydroxide | 10 g |
| Water to make | 1 liter |

TABLE 2

| Test specimen No. | Gelatin and | | Hardening degree (g) |
|---|---|---|---|
| 1 | Solution | A-0 | 6 |
| 2 | Conversion mixture | A-1 | 20 |
| 3 | Conversion mixture | A-2 | 26 |
| 4 | Conversion mixture | A-3 | 35 |
| 5 | Conversion mixture | A-4 | 50 |
| 6 | Conversion mixture | A-5 | 72 |
| 7 | Solution | B-0 | 4 |
| 8 | Conversion mixture | B-1 | 20 |
| 9 | Conversion mixture | B-2 | 52 |
| 10 | Conversion mixture | B-3 | 60 |
| 11 | Conversion mixture | B-4 | 72 |

Test specimens No. 1 and No. 7, which had been kept at 50° C. for 4 days, were further kept at 50° C. for 6 days and tested for the hardening degree. The hardening degrees of both test specimens were found to be on nearly the same level as that of test specimen No. 2 shown in Table 2.

As is apparent from Tables 1 and 2, with the increase in heating time the solution of the mixture of polyvinyl alcohol and ethylene-maleic anhydride copolymer is increased in viscosity and the conversion mixture formed in the solution is also increased in hardening effect.

By suitably selecting the polymerization degree or average molecular weight, mixing ratio, and heating conditions of polyvinyl alcohol and ethylene-maleic anhydride copolymer, it is possible to obtain a variety of conversion mixtures having different viscosities and different hardening effect. Consequently, it becomes possible to prepare a coating composition having a viscosity most suitable for a particular coating procedure or to minimize or even cut out the amount of a hardener which is necessary if gelatin is used alone.

REFERENCE EXAMPLE 2

The following three types of solutions were prepared.

Solution C (conversion mixture C)

| | |
|---|---|
| Solution C (conversion mixture C): | |
| 10% Aqueous solution of polyvinyl alcohol | 750 g |
| 10% Aqueous solution of vinyl methyl ether-maleic anhydride | 250 g |
| Solution D (conversion mixture D): | |
| 10% Aqueous solution of polyvinyl alcohol | 750 g |
| 10% Aqueous solution of styrene-maleic anhydride copolymer | 250 g |
| Solution E (conversion mixture E): | |
| 10% Aqueous solution of polyvinyl alcohol | 750 g |
| 10% Aqueous solution of isobutylene-maleic anhydride copolymer | 250 g |

Each solution was adjusted to pH 4.0 and heated at 80° C. or a higher temperature for 180 minutes to obtain conversion mixtures C, D and E. The polyvinyl alcohol used had an average polymerization degree of 1,700 and a saponification degree of 98% or more. The solutions containing gelatin and the conversion mixtures obtained above or the conversion mixtures A-4 and B-3 obtained in Reference Example 1 were tested for gelation temperature in the following manner.

An aqueous solution containing 3% of solids was prepared by mixing a 3% aqueous solution of gelatin and a 3% aqueous solution containing a conversion mixture in a ratio of 4:1 or 3:1 on solids basis. With respect to 100 g portion of each solution gelation temperature (setting temperature) was measured according to PAGI method. The results obtained were as shown in Table 3.

TABLE 3

| Solution No. | Binder | | | Mixing ratio (solids) | Gelation temperature(°C.) |
|---|---|---|---|---|---|
| 1 | | Gelatin | | — | 14.4 |
| 2 | Gelatin: | Conversion mixture | A-4 | 4:1 | 19 |
| 3 | Gelatin: | Conversion mixture | B-3 | " | 18 |
| 4 | Gelatin: | Conversion mixture | C | " | 14 |
| 5 | Gelatin: | Conversion mixture | D | " | 17 |
| 6 | Gelatin: | Conversion mixture | E | " | 14 |
| 7 | Gelatin: | Conversion mixture | A-4 | 3:1 | 19 |
| 8 | Gelatin: | Conversion mixture | B-3 | " | 17 |
| 9 | Gelatin: | Conversion mixture | C | " | 15.5 |
| 10 | Gelatin: | Conversion mixture | D | " | 16 |
| 11 | Gelatin: | Conversion mixture | E | " | 14 |

Solutions No. 2, No. 3, No. 7 and No. 8 containing the conversion mixture of this invention showed a higher gelation temperature, meaning that the conversion mixture of this invention has advantageous physical properties for the manufacture of photographic elements, particularly the coating process, and, hence, is useful as a binder.

The conversion mixtures A-4, B-3, C, D and E were stored for 25 days at room temperature. The conversion mixtures C, D and E showed a marked increase in viscosity, whereas the conversion mixtures A-4 and B-3 undergone little change in viscosity, indicating an excellent storage stability.

REFERENCE EXAMPLE 3

Conversion mixtures B-3 of Reference Example 1, C and D of Reference Example 2 were each mixed with a gelatin solution in a weight ratio of 1:1 on solids basis. The resulting solution was coated on a polyethylene-coated paper sheet, 90 g/m$^2$ in basis weight, so that the thickness of dried coating became 2$\mu$ and dried. For comparison, a test specimen was prepared by coating the support with a coating composition containing gelatin as sole binder. The specimens thus obtained were tested for the following items.

Curl: A disc, 14.5 cm in diameter, was cut out of each specimen and after having been left for 2 hours at 20° C. and 15% RH on a horizontal plane, measurement was performed for the distance (in cm) between two highest points which are opposite to each other on the arcs lifted from the horizontal plane due to curling of the disc.

Adhesion (dry): A piece of adhesive tape ("Cellotape", trademark for Nichiban Co.), 18 mm in width and of suitable length, was pressed against the coating surface of the test specimen so that the end portion, 3 cm in length, of the tape may adhere firmly to the test specimen. The tape was then peeled off by applying a sudden pull to the free end of the tape. The adhesion of the coating layer to the support was rated as follows:

o: No separation between the coating layer and the support.

Δ: Partial separation.

x: Complete separation.

The test results were as shown in Table 4.

TABLE 4

| Specimen No. | Binder | Curl (cm) | Adhesion (dry) |
|---|---|---|---|
| 7 | Gelatin | 11.2 | o |
| 8 | Gelatin + conversion mix. B-3 | 13.6 | o |
| 9 | Gelatin + conversion mix. C | 12.0 | Δ |
| 10 | Gelatin + conversion mix. D | 10.0 | x |

As is apparent from Table 4, the test specimen No. 8 containing the conversion mixture of this invention is superior in curl and dry adhesion over other specimens.

Further, a specimen (No. 11) was similarly prepared by using solution A-0 of Reference Example 1. After having been heated at 50° C. for 10 days, the specimen was tested for the adhesion (dry) and compared with untreated specimen. The results obtained were as shown in Table 5.

TABLE 5

| Specimen No. 11 | Immediately after preparation | After heating at 50 ° C. for 10 days |
|---|---|---|
| Adhesion (dry) | x | o |

EXAMPLE 1

To a silver chlorobromide photosensitive emulsion containing 50 mole-% of silver bromide and having a sensitivity equivalent to that of an enlargement paper, which was prepared by common procedure using a quaterpolymer composed of 8 mole-% of 1-vinyl-2-methylimidazole, 7 mole-% of acrylic acid, 25 mole-% of diacetoneacrylamide and 60 mole-% of acrylamide, were added zirconium nitrate and magnesium sulfate to precipitate the emulsion. The precipitated emulsion was thoroughly washed with cold water and re-dispersed by adding water which had been adjusted to pH 4.3 to 4.5 with a solution containing citric acid and sodium citrate. To 1,000 g of the redispersed emulsion containing 20 g of the resin and 50 g of silver chlorobromide, were added 130 g on solids basis of the conversion mixture B-2 of Reference Example 1, a stabilizer and other necessary additives and water to make the total weight of the resulting coating composition to 3,000 g. The coating composition was coated on a polyethylene-coated paper sheet, 90 g/m$^2$ in basis weight, which had been exposed to corona discharge, by the high-speed extrusion bar coating technique and dried.

For comparison, a specimen was prepared in the same manner as above-mentioned, except that conversion mixture D of Reference Example 2 was used in place of the conversion mixture B-2.

As compared with the photographic enlargement paper prepared by using the conversion mixture D, that prepared by using the conversion mixture B-2 showed very little curl, better adhesion of the photographic layer to the polyethylene-coated paper support, and more satisfactory photographic performance.

EXAMPLE 2

To 200 g of a silver halide photographic emulsion prepared by a common procedure using gelatin and subjected to second ripening, which contained 5 g of gelatin and 25 g of silver iodobromide, were added 35 g on solids basis of conversion mixture A-5 of Reference Example 1, necessary additives including a stabilizer, and water to make the total to 650 g. The resulting emulsion was coated on a common subcoated polyester film base and dried. The resulting photosensitive film element showed very little curl and good photographic performance.

Next, a coating composition was prepared by mixing 40 g on solids basis of the conversion mixture A-5, 2 g of a commercial antihalation dyestuff bleachable during processing, additives including a coating aid, and water to make the total to 1,000 g. The coating composition was coated on the back side of the film base of the above photographic element to form an antihalation layer and dried. The resulting photographic film element was found to form a silver image with increased sharpness.

EXAMPLE 3

An image receiving paper sheet for the silver complex diffusion transfer process was prepared by coating a polyethylene-coated paper sheet, 90 g/m$^2$ in basis weight, which had been exposed to corona discharge, with an aqueous composition prepared by incorporating colloidal nickel sulfide nuclei into an aqueous composition given below.

The image-receiving paper sheet obtained above and a diffusion transfer negative paper sheet having an image-wise exposed silver halide emulsion layer were immersed for several seconds into a silver complex diffusion transfer image developing solution of the composition given below. Both sheets were brought into close contact with each other and after 30 seconds both sheets were peeled apart. The image receiving sheet showed very little curl even at a low humidity as low as 15% RH and the formed silver image was satisfactory.

Protective colloid composition to be incorporated with colloidal nuclei:

| | |
|---|---|
| Gelatin | 25 g |
| Conversion mixture A-4 of Reference Example 1 (as solids) | 30 g |
| Water to make to | 1,000 g |

Silver complex diffusion transfer developing solution:

| | |
|---|---|
| Sodium thiosulfate, Anhy. | 15 g |
| Sodium sulfite, Anhy. | 69 g |
| Potassium bromide | 1.0 g |
| Hydroquinone | 13 g |
| Phenidone | 1 g |
| Sodium hydroxide | 10 g |
| Water to make to | 1,000 cc |

EXAMPLE 4

Two coating compositions were prepared by incorporating colloidal nickel sulfide nuclei into an aqueous solution containing 55 g of gelatin and a predetermined amount of a hardening agent or into an aqueous solution containing 25 g of gelatin and 30 g on solids basis of the conversion mixture B-3 of Reference Example 1 and adding water to make each aqueous solution to 1,000 ml. Each coating composition was coated on a polyethylene-coated paper sheet, 90 g in basis weight, which had been exposed to corona discharge, so that the thickness of dried coating became 2$\mu$ and dried. The specimens thus treated were kept at 50° C. for 4 hours. Each specimen and a diffusion transfer negative paper sheet having an image-wise exposed silver halide emulsion layer were immersed for several seconds into the same silver complex diffusion transfer image developing solution as used in Example 3. Both sheets were then brought into close contact with each other and after 30 seconds both sheets were peeled apart. The reflection and transmission densities of the transferred silver images were measured to obtain the results as shown in Table 6.

TABLE 5

| Specimen No. | Binder | Reflection density | Transmission density |
|---|---|---|---|
| 12 | Gelatin | 1.60 | 3.40 |
| 13 | Gelatin + conversion mix. B-3 | 1.75 | 3.90 |

As is apparent from Table 6, the silver complex diffusion transfer image receiving paper sheet (specimen No. 13) having an image receiving layer comprising gelatin and the conversion mixture B-3 has desirable photographic performance characteristics, particularly a higher transfer image density, lower curling tendency and better adhesion between the image receiving layer and the support than those of the specimen (No. 12) in which gelatin is used as the sole binder.

What is claimed is:

1. A photographic element having a photographic layer containing a conversion mixture of a polyvinyl alcohol having a saponification degree of 98% or more and an ethylene-maleic anhydride copolymer.

2. A photographic element of claim 1, wherein the polyvinyl alcohol has a polymerization degree of 300 to 2,000.

3. A photographic element of claim 1, wherein the conversion mixture contains the ethylene-maleic anhydride copolymer having an average molecular weight of 8,000 to 100,000.

4. A photographic element of claim 1, wherein the conversion mixture contains the polyvinyl alcohol constituent and ethylene-maleic anhydride copolymer constituent in a proportion of 1,000 g of the former and 100–500 g of the latter.

5. A photographic element of claim 1, wherein the photographic layer is an image receiving layer of the silver complex diffusion transfer element.

6. A photographic element of claim 1, wherein the amount of the conversion mixture contained in the photographic layer is at least 5% based on the layer.

7. A photographic element of claim 1, wherein the photographic layer contains the conversion mixture and gelatin.

8. A photographic element of claim 1, wherein the photographic layer is present in contact with a resin-coated surface of a support.

9. A photographic element according to claim 1 wherein the polyvinyl alcohol has a polymerization degree of 300 to 2,000 and the conversion mixture contains an ethylene-maleic anhydride copolymer having an average molecular weight of 8,000 to 100,000.

10. A photographic element according to claim 9 wherein the conversion mixture contains the polyvinyl alcohol constituent and ethylene-maleic anhydride copolymer constituent in a proportion of 1,000 g of the former and 100–500 g of the latter.

11. A photographic element according to claim 10 wherein the photographic layer is an image receiving layer of the silver complex diffusion transfer element.

12. A photographic element according to claim 1 wherein the conversion mixture is obtained by heating a mixture consisting of polyvinyl alcohol having a saponification degree of at least 98% and an ethylene-maleic anhydride copolymer in aqueous solution.

* * * * *